US007669738B1

(12) United States Patent
Byers

(10) Patent No.: US 7,669,738 B1
(45) Date of Patent: Mar. 2, 2010

(54) WATER TRANSFER SYSTEM FOR A BOTTLED WATER DISPENSER

(76) Inventor: Thomas L. Byers, 5840 Stewart Dr., Mustang, OK (US) 73064

( * ) Notice: Subject to any disclaimer, the term of this patent is extended or adjusted under 35 U.S.C. 154(b) by 949 days.

(21) Appl. No.: 11/176,127

(22) Filed: Jul. 7, 2005

(51) Int. Cl.
*B67D 5/64* (2006.01)

(52) U.S. Cl. ..... 222/164; 222/83.5; 222/400.8; 222/464.7; 141/196; 141/198; 248/139; 248/143; 280/47.11; 280/47.12; 280/47.23; 280/47.24

(58) Field of Classification Search ..... 222/164–172, 222/464.1, 386.5, 389, 509, 80, 83.5, 160, 222/400.7–400.8, 464.7, 501; 141/18, 182, 141/196, 198, 285, 301, 363; 280/47.1, 47.11, 280/47.12, 47.17, 47.19, 47.23, 47.24; 248/129–131, 248/133, 135, 137, 139, 143, 145.3
See application file for complete search history.

(56) References Cited

U.S. PATENT DOCUMENTS 297,058 A * 4/1884 Best ..... 137/124
993,265 A * 5/1911 McCoy ..... 414/490
1,220,640 A * 3/1917 Kelly ..... 248/129
1,461,820 A * 7/1923 Eck ..... 414/457
1,479,223 A * 1/1924 Carroll ..... 280/47.18
1,754,377 A * 4/1930 Tower ..... 62/391
1,885,678 A * 11/1932 Boyer ..... 222/396
2,077,349 A * 4/1937 Hobbis ..... 414/450
2,311,726 A * 2/1943 Blue ..... 222/160
2,509,240 A * 5/1950 Meehan ..... 414/448
2,522,894 A * 9/1950 Putman ..... 414/457
2,805,798 A * 9/1957 Sampson ..... 222/309
2,832,425 A * 4/1958 Jacobs ..... 169/74
3,026,006 A * 3/1962 Frankfurt ..... 222/400.7
3,065,885 A * 11/1962 Chatten ..... 222/400.7
3,120,906 A * 2/1964 Harnage ..... 222/321.9
3,182,866 A * 5/1965 Rowe ..... 222/464.1
3,247,360 A * 4/1966 Ponder ..... 219/436
3,269,143 A * 8/1966 Gasparovich ..... 62/389
3,464,435 A * 9/1969 Lamb et al. ..... 137/212
3,490,483 A * 1/1970 Nicko ..... 137/212
3,495,612 A * 2/1970 Learn et al. ..... 137/209
3,527,391 A * 9/1970 Dimuria ..... 222/400.7
3,788,343 A * 1/1974 Neidorf et al. ..... 137/209
3,848,776 A * 11/1974 Schieser ..... 222/105
3,888,424 A * 6/1975 Chapman et al. ..... 239/657
3,913,608 A * 10/1975 Johnston ..... 137/322
3,979,002 A * 9/1976 Faulstich ..... 215/256

(Continued)

*Primary Examiner*—Kevin P Shaver
*Assistant Examiner*—Andrew P Bainbridge
(74) *Attorney, Agent, or Firm*—Fellers, Snider, et al.

(57) ABSTRACT

Apparatus for transferring water to a bottled water dispenser preferably comprises a wand assembly, a cover assembly and a water bottle transport assembly. The wand assembly engages a neck of a non-inverted water bottle and includes a bent, rigid first conduit and a second conduit which preferably surrounds the first conduit. A flow of water from the water bottle passes along the first conduit in response to the introduction of pressurized air via the second conduit from a pressurized air source in the cover assembly. The water bottle transport assembly preferably supports the water bottle at a suitable, non-inverted angle, and includes a rigid frame supporting at least one wheel and a rotatable cradle. The cradle comprises first and second support arms configured to contactingly support the bottle, and rotates with respect to the frame during movement of the transport assembly to place the bottle at the desired non-inverted angle.

15 Claims, 9 Drawing Sheets

U.S. PATENT DOCUMENTS 4,030,634 A * 6/1977 Osborn ..... 222/23
4,143,784 A 3/1979 Frahm et al.
4,153,181 A * 5/1979 Parker et al. ..... 222/61
4,158,462 A * 6/1979 Coral ..... 285/144.1
4,174,743 A * 11/1979 Beny et al. ..... 141/18
4,289,158 A * 9/1981 Nehring ..... 137/205
4,361,257 A * 11/1982 Stone, Jr. ..... 222/464.1
4,440,319 A * 4/1984 Nitchman et al. ..... 222/131
4,456,149 A 6/1984 Sciortino
4,475,667 A * 10/1984 Ori et al. ..... 222/39
4,488,657 A * 12/1984 Deland ..... 215/303
4,534,484 A * 8/1985 Deland ..... 215/307
RE32,354 E * 2/1987 Savage ..... 222/81
4,735,348 A * 4/1988 Santoiemmo et al. ..... 222/399
4,741,448 A * 5/1988 Alley et al. ..... 215/266
4,756,540 A * 7/1988 Crawford ..... 280/47.21
4,852,621 A * 8/1989 Bear ..... 141/83
4,958,747 A * 9/1990 Sheets ..... 222/67
4,990,061 A * 2/1991 Fowler et al. ..... 417/143
5,031,676 A * 7/1991 Ulm ..... 141/346
5,104,135 A * 4/1992 Sheets ..... 280/47.19
D326,608 S 6/1992 Frahm
5,121,778 A 6/1992 Baker et al.
5,121,970 A * 6/1992 Andersen ..... 298/3
5,133,484 A * 7/1992 Globert et al. ..... 222/376
5,232,125 A * 8/1993 Adams ..... 222/83.5
5,238,146 A * 8/1993 Thorne, Jr. ..... 222/1
5,267,674 A * 12/1993 von Schuckmann ..... 222/401
5,273,083 A * 12/1993 Burrows ..... 141/18
5,292,038 A * 3/1994 Seney ..... 222/402.13
5,295,519 A * 3/1994 Baker et al. ..... 141/18
5,316,248 A * 5/1994 Allen ..... 248/129
5,390,832 A * 2/1995 Lombardo ..... 222/394
5,456,294 A * 10/1995 Tsao et al. ..... 141/1
5,464,129 A * 11/1995 Ho ..... 222/377
5,482,190 A * 1/1996 Stanek et al. ..... 222/501
5,507,324 A * 4/1996 Whitley et al. ..... 141/59
5,507,329 A * 4/1996 Shub ..... 141/351
5,526,961 A * 6/1996 Burrows ..... 222/185.1
5,540,355 A * 7/1996 Hancock et al. ..... 222/56
5,551,716 A * 9/1996 Kordecki et al. ..... 280/47.18
5,573,047 A * 11/1996 Akin ..... 141/330
5,582,503 A * 12/1996 Sandoval ..... 414/738
5,593,271 A * 1/1997 Hall ..... 414/490
5,611,459 A 3/1997 Hinch
5,638,991 A * 6/1997 Todden et al. ..... 222/113
5,653,270 A * 8/1997 Burrows ..... 141/18
5,730,334 A * 3/1998 Mizrahi ..... 222/185.1
5,749,588 A * 5/1998 Stallbaumer ..... 280/47.27
5,868,281 A * 2/1999 Bietzer et al. ..... 222/83.5
5,913,527 A * 6/1999 Hailston ..... 280/47.28
5,967,197 A * 10/1999 Shown ..... 141/18
6,048,123 A * 4/2000 Holt et al. ..... 401/138
6,109,480 A * 8/2000 Monsrud et al. ..... 222/83
6,155,460 A * 12/2000 Lee ..... 222/146.6
6,167,921 B1 * 1/2001 Busick et al. ..... 141/18
6,247,710 B1 * 6/2001 Luberda ..... 280/47.28
6,347,907 B1 * 2/2002 Halstead ..... 404/85
6,375,001 B1 * 4/2002 Beach ..... 206/217
6,398,073 B1 * 6/2002 Nicolle ..... 222/67
6,474,507 B1 * 11/2002 Hornsby et al. ..... 222/79
6,648,184 B1 * 11/2003 Williams et al. ..... 222/487
6,691,893 B2 * 2/2004 Gauthier ..... 222/95
6,756,069 B2 * 6/2004 Scoville et al. ..... 426/594
6,834,815 B2 * 12/2004 Appleby ..... 239/334
6,868,986 B1 * 3/2005 Arnold ..... 222/66
6,945,545 B2 * 9/2005 Celli ..... 280/47.18
7,131,556 B2 * 11/2006 Tseng ..... 222/64
7,135,106 B2 * 11/2006 Marquis et al. ..... 210/97
2001/0011802 A1 * 8/2001 Meabon ..... 280/47.18
2002/0046569 A1 * 4/2002 Faqih ..... 62/188
2002/0114689 A1 * 8/2002 McGill et al. ..... 414/634
2002/0148853 A1 * 10/2002 Gauthier ..... 222/95
2003/0065316 A1 * 4/2003 Levine et al. ..... 606/33
2003/0080236 A1 * 5/2003 Armstrong ..... 242/557
2003/0153803 A1 * 8/2003 Harmon ..... 600/6
2004/0020001 A1 * 2/2004 Lorincz et al. ..... 15/322
2004/0065684 A1 * 4/2004 Cooke et al. ..... 222/146.6
2004/0140327 A1 * 7/2004 Osborne et al. ..... 222/386.5
2004/0226960 A1 * 11/2004 Aguirre et al. ..... 222/1
2004/0227012 A1 * 11/2004 Appleby ..... 239/334
2007/0040048 A1 * 2/2007 Poizot ..... 239/343

* cited by examiner

WATER TRANSFER SYSTEM FOR A BOTTLED WATER DISPENSER

FIELD OF THE INVENTION

The claimed invention relates generally to the field of liquid dispensing systems and more particularly, but not by way of limitation, to an apparatus for transferring water to a bottled water dispenser.

BACKGROUND

Bottled water dispensers are employed in commercial and residential settings to provide a convenient source of potable water. Such dispensers often employ a base unit with one or more spigots to dispense the water from an internal reservoir. The base unit is often further configured to receivingly support an inverted water bottle above the reservoir. In this way, water empties from the bottle into the reservoir as water is correspondingly drawn from the reservoir through the spigot (s).

While operable, there are a number of limitations associated with this type of dispenser. The first limitation is the need to physically lift and place the water bottle onto the base unit. Such water bottles are usually relatively large and cumbersome; a full, standard five (5) gallon plastic bottle of water can weigh in excess of forty (40) pounds. The effort required to lift or carry a full water bottle can be strenuous for an adult male, and may be prohibitive for many women, children, elderly or handicapped persons.

Depending on the configuration of the bottle, water can be spilled through the neck opening of the bottle during the placement process. A water bottle can also crack open if inadvertently dropped, resulting in the flow of several gallons of water onto the floor. In situations where the volume of consumed water is relatively high, there is also the need to stockpile multiple full water bottles in a central storage location, and then to carry each full water bottle from this location to the base unit as needed.

Thus, as water dispensing units continue to enjoy widespread popularity, there remains a continual need for improvements to address these and other limitations of the prior art.

SUMMARY OF THE INVENTION

Preferred embodiments of the present invention are generally directed to an apparatus for transferring water to a bottled water dispenser.

In accordance with some preferred embodiments, a wand assembly is configured to engage a neck of a non-inverted water bottle to draw water therefrom. The wand assembly preferably comprises a housing with respective inlet and outlet ports. A bent, rigid first conduit is coupled to the outlet port and extends from the housing into an interior of the water bottle. The first conduit comprises a first segment extending in a first direction and a second segment extending from the first segment in a second direction non-parallel to the first direction. A second conduit is coupled to the inlet port and extends from the housing into the interior of the water bottle.

In this way, a flow of pressurized water from the water bottle passes along the first conduit and to the outlet port in response to a flow of pressurized air from a pressurized air source through the inlet port and the second conduit. Preferably, the first and second conduits are aligned so that the second conduit surrounds the first segment of the first conduit.

Preferably, the water bottle comprises a resealable stopper assembly with a central aperture passing therethrough to the interior of the water bottle. The first and second conduits are preferably adapted to sealingly pass through this central aperture. The stopper assembly further preferably comprises an interior removeable plug. The second segment of the first conduit comprises a distal end configured to engage said plug so that, as the first conduit is inserted into the bottle, the plug is removed from the stopper assembly and, as the first conduit is subsequently removed from the bottle, the plug is replaced onto the stopper assembly.

In further preferred embodiments, a water bottle transport assembly is adapted to transport a water bottle in a substantially non-inverted orientation. The transport assembly preferably comprises a rigid frame supporting at least one wheel and comprising a user handle, and a cradle supported by and rotatable with respect to the frame. The cradle comprises first and second support arms configured to contactingly support opposing first and second exterior sides of the bottle. The first and second support arms are further configured to pass adjacent to the respective first and second exterior sides of the bottle to engage said sides without lifting or tilting said bottle.

The cradle further preferably comprises a central support surface configured to contactingly support a third exterior side of the bottle between the first and second exterior sides. In this way, the bottle is tilted into a supported orientation in the cradle and the third exterior side of the bottle contactingly abuts the central support surface of the cradle.

In further preferred embodiments, a cover assembly is provided to sealingly cover an inlet aperture of the water dispenser unit, with the aperture being nominally configured to receive the water bottle in an inverted orientation to pass water from the bottle to an underlying reservoir.

The cover assembly preferably comprises an air pump coupled to a flexible third conduit to pass said flow of pressurized air to the inlet port. A flexible fourth conduit passes from the outlet port and through the cover assembly. Thus, upon operation of the air pump, said flow of pressurized air is directed along the third conduit and a return flow of said pressurized water is directed along the fourth conduit and into the reservoir.

These and various other features and advantages which characterize the claimed invention will become apparent upon reading the following detailed description and upon reviewing the associated drawings.

DETAILED DESCRIPTION

FIGS. 1A-1B and 2A-2B illustrate various views of a water transfer system 100 constructed and operated in accordance with preferred embodiments of the present invention. The water transfer system 100 is adapted to provide water from a water bottle 102 to a conventional bottled water dispenser unit 104. The dispenser unit 104 is preferably of the type adapted to receivingly support the bottle 102 in an inverted position, and includes an interior reservoir (not shown) from which water is selectively drawn by way of one or more spigots 106.

Figure 2A:
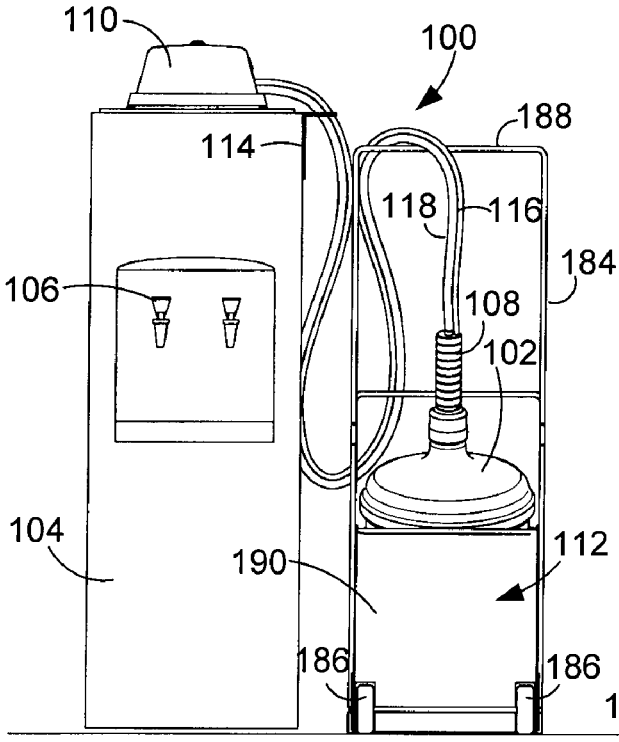
FIGS. 2A and 2B provide front and side views, respectively, of the water transfer system of FIGS. 1A and 1B in an operative orientation.
Figure 2B:
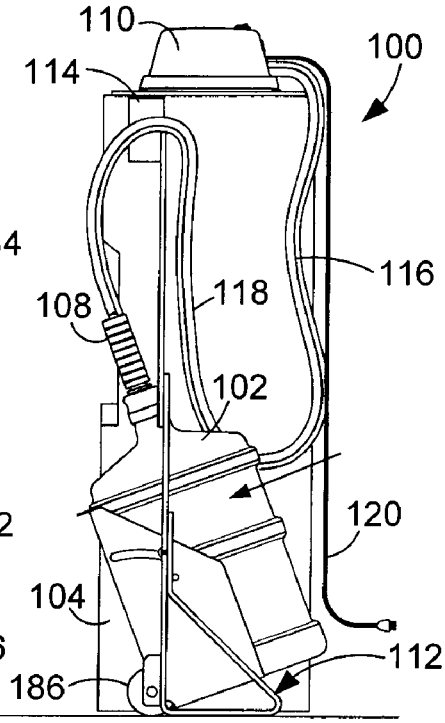

The water transfer system 100 preferably comprises three primary components: a wand assembly 108, a cover assembly 110, and a water bottle transport assembly 112. As explained in greater detail below, the wand assembly 108 is inserted into the water bottle 102 during operation, as depicted in the views of FIGS. 2A and 2B.

Figure 1A:
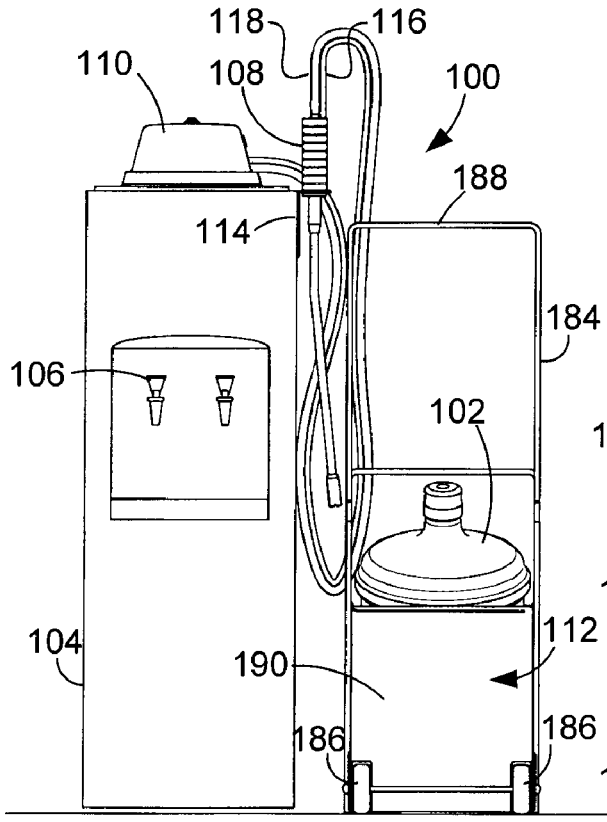
FIGS. 1A and 1B provide front and side views, respectively, of a water transfer system constructed and operated in accordance with preferred embodiments of the present invention to provide water to a bottled water dispenser unit.
Figure 1B:
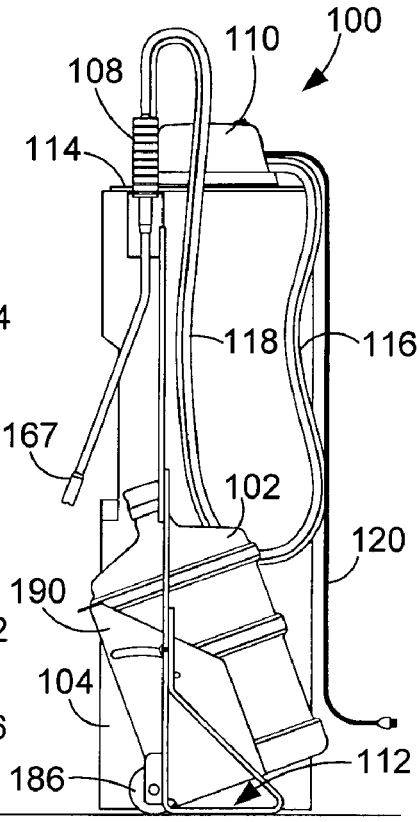

The wand assembly 108 is retracted from the water bottle 102 when not in use (such as during a water bottle changing operation), as depicted in the views of FIGS. 1A and 1B. As desired, the wand assembly 108 can be conveniently supported on a support flange 114 when not in use. The support flange 114 is preferably supplied with the system 100 and attached to the side of the dispenser unit 104 using double sided adhesive tape or other suitable attachment means.

The cover assembly 110 is adapted to be supported over the interior reservoir in the dispenser unit 104. The cover assembly 110 provides a supply of pressurized air to the wand assembly 108 to pressurize the water bottle 102. This pressurized air is provided along a first flexible conduit 116, and results in the movement of water along a second flexible conduit 118 from the bottle 102 to the interior reservoir. Electrical power is provided to the cover assembly via cord 120.

The transport assembly 112 is preferably characterized as a modified "hand truck," and facilitates movement of the water bottle 102 to a position adjacent the dispenser unit 104. The transport assembly 112 further preferably supports the water bottle 102 at a suitable, non-inverted angle (best viewed in FIGS. 1B and 2B) as water is drawn from the bottle by the wand assembly 108.

Figure 3:
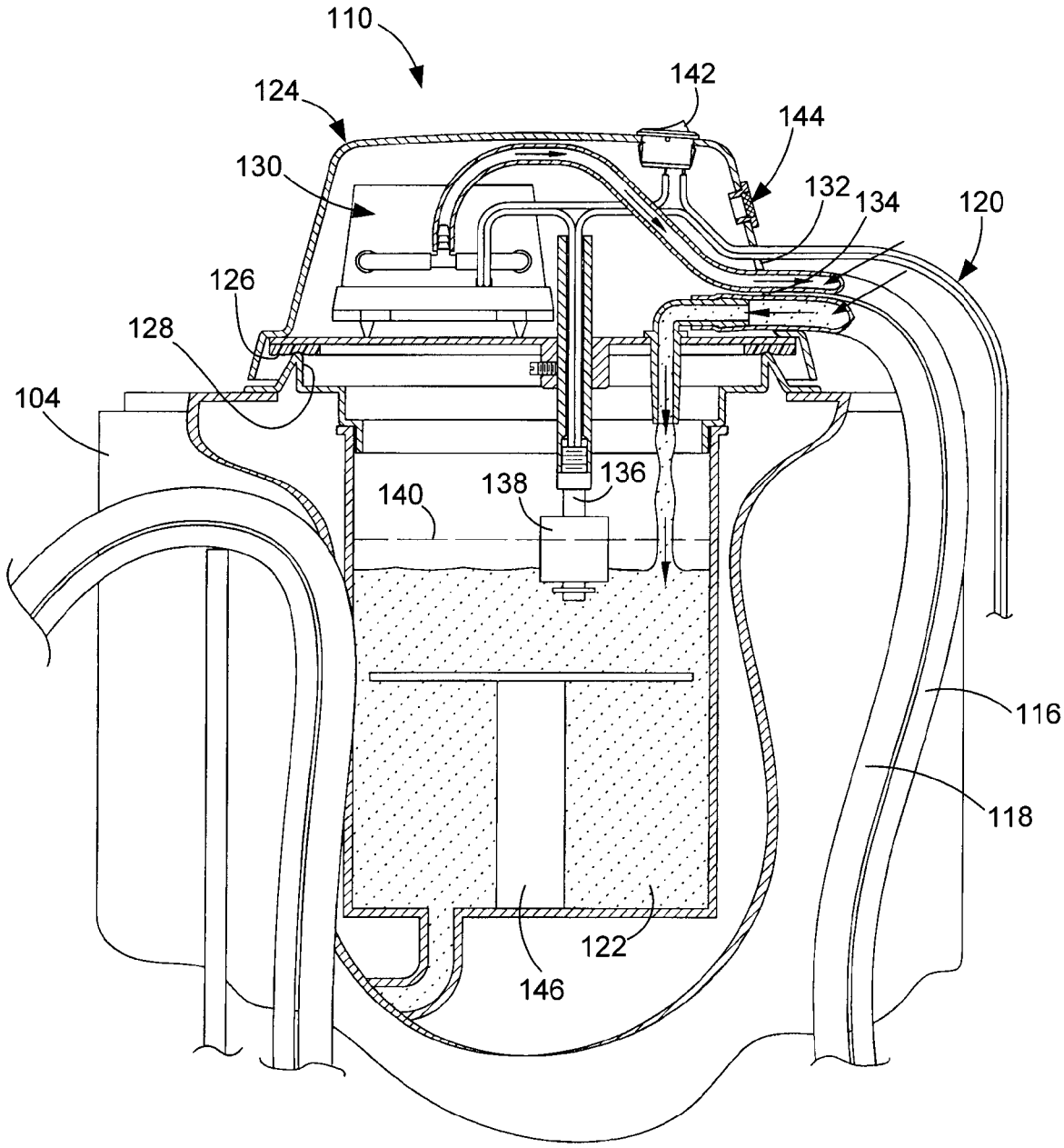
FIG. 3 illustrates a cover assembly of the water transfer system in conjunction with an internal reservoir of the dispenser unit of FIGS. 1A-2B.

FIG. 3 shows the cover assembly 110 in conjunction with the aforementioned interior reservoir (numerically denoted at 122) of the dispenser unit 104. The cover assembly 110 includes a generally bell-shaped housing 124 with a lower sealing surface 126 adapted to mate with an annular bottle support surface 128 of the dispenser unit 104.

The housing 124 supports an air pump 130 which can take any number of suitable forms, such as a conventional aquarium pump. The pump 130 is coupled to the first flexible conduit 116 via outlet port 132 to supply the aforementioned supply of pressurized air thereto. A resulting flow of water from the second flexible conduit 118 flows through inlet port 134 and into the reservoir 122 as shown.

A level sensor 136 projects from the housing 124 toward the reservoir 122, and is electrically connected in series with the pump 130. The sensor 136 is preferably characterized as a magnetic reed switch with a float 138 that rises and lowers in relation to the level of water in the reservoir 122. The switch 136 opens when the water reaches line 140, and closes when the water falls below this level. In this way, the sensor 136 continuously regulates the amount of water present in the reservoir 122.

A user-activated on-off switch 142 is connected in series with the pump 130 and is located for easy access on top of the housing 124. A filtered vent aperture 144 permits inlet air to flow into the housing 124 to replenish that air pumped by the pump 130 along conduit 116. FIG. 3 also shows an interior baffle 146 in the reservoir 122 which normally operates to facilitate the flow of water from the water bottle 102 when the bottle is inverted onto the dispenser unit 104. The baffle 146 is generally unnecessary when the system 100 is in place, and so the baffle can be retained in place, or removed if clearance is needed for the sensor 136.

Figure 4:
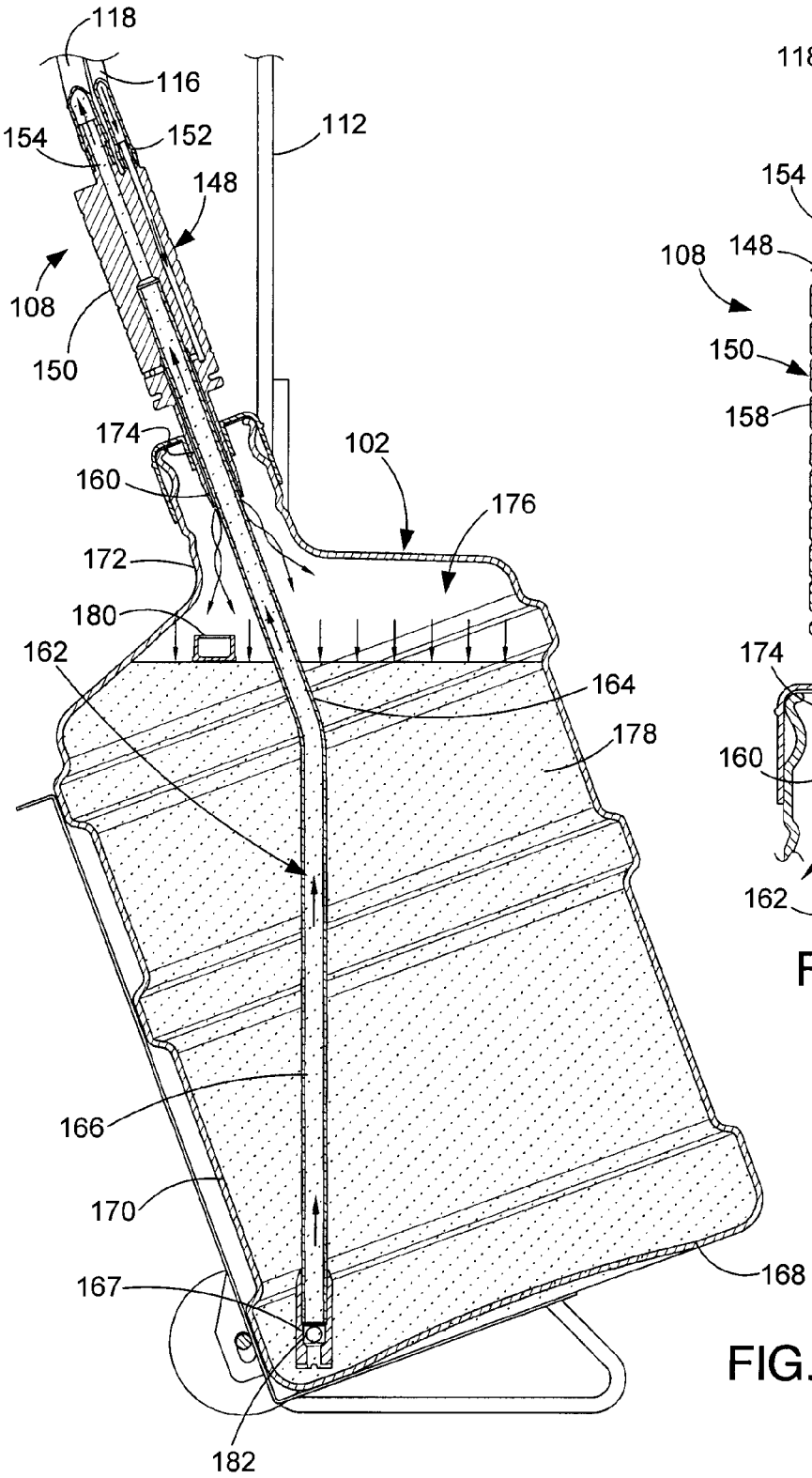
FIG. 4 depicts a wand assembly of the water transfer system adapted for insertion into a water bottle, as well as a water bottle transport assembly of the water transfer system adapted to selectively support and transport said water bottle.
Figure 4A:
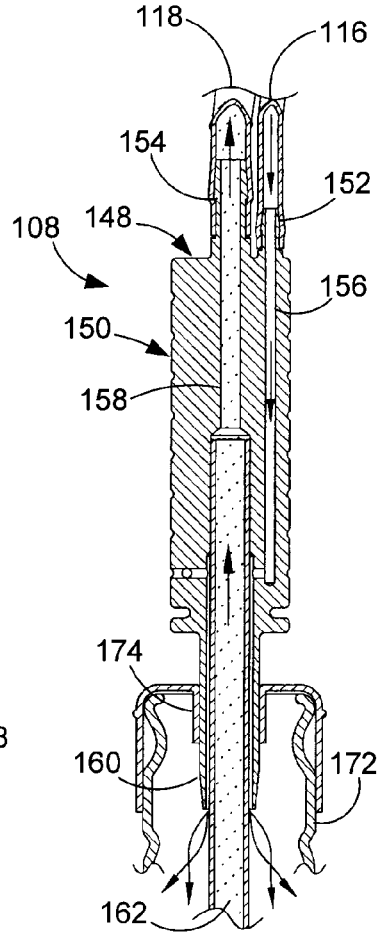
FIG. 4A shows portions of the wand assembly of FIG. 4 in greater detail.

FIG. 4 provides a cross-sectional, elevational view of the wand assembly 108 installed in the water bottle 102, and so generally corresponds to the previous view of FIG. 2B. The wand assembly 108 preferably includes an elongated handle 148 with an exterior grip surface 150. As shown in greater detail in FIG. 4A, the flexible conduits 116, 118 are coupled to the handle 148 via ports 152, 154. Interior channels 156, 158 provide respective fluidic communication paths to a pair of conduits 160, 162 which extend from the lower end of the wand assembly 108.

The conduit 162, herein also referred to as a "first conduit," preferably comprises a rigid, bent member having a first segment 164 which extends into the bottle 102 in a first direction (preferably along a central axis of the bottle 102). A second segment 166 extends from the first segment 164 in a second direction non-parallel to the first direction. Preferably, the second segment 166 terminates at a tip assembly 167 adjacent a junction between a base 168 and a sidewall 170 of the water bottle 102, as shown.

The transport assembly 112 preferably maintains the bottle 102 at a suitable non-inverted angle, such as about 20 degrees from horizontal. The respective lengths and angles of the rigid first and second segments 164, 166 can vary as desired, but are preferably selected to permit unrestricted insertion and retraction of the wand assembly 108 into the bottle 102, as well as to permit the tip assembly 167 to substantially reach the lowest extent of the bottle 102, as depicted in FIG. 4.

The conduit 160, herein also referred to as a "second conduit," preferably comprises an annular member which surrounds the first conduit 162. Unlike the first conduit 162, the second conduit 160 does not extend significantly into the interior of the bottle 102, but instead terminates in the vicinity of a neck portion 172 of the bottle 102. The neck portion 172 includes a sidewall 174 that forms a central opening for the bottle 162, and the second conduit 160 is preferably sized to form a compression seal against the sidewall 174 when the wand assembly 108 is inserted into the bottle 102 (best viewed in FIG. 4A).

The pressurized air from the pump 130 of the cover assembly 110 (FIG. 3) thus passes out of the outlet port 132, along flexible conduit 116 to inlet port 152 of the wand assembly 108, along interior channel 156, and then through the second conduit 160 to a vapor space 176 within the bottle 102 above the water stored therein (the latter denoted at 178). This pressurized air preferably enters the vapor space 176 by flowing through a "gap" between the inner surface of the second conduit 160 and the outer surface of the first conduit 162.

The pressurized vapor space 176 forces the water 178 from the water bottle 102 to flow up through the tip assembly 167, along the second segment 166 and then the first segment 164 of the first conduit 160, along interior channel 158, through port 154, along flexible conduit 118, through inlet port 134 (FIG. 3) and the housing 124 to the reservoir 122.

FIG. 4 further shows a water bottle plug 180 floating on the top surface of the water 178. This plug 180 is provided in some bottle designs and is used to sealingly nest within the water bottle opening against the sidewall 174 in order to prevent water from leaking from the bottle during transport and storage.

Figure 5A:
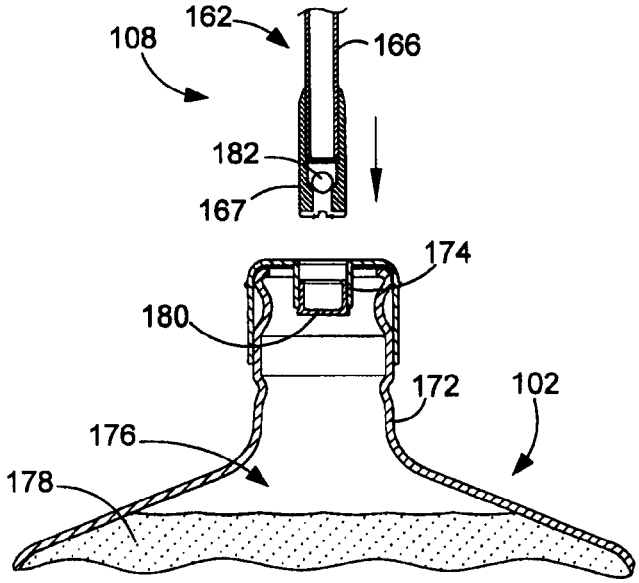
FIGS. 5A-5C show a preferred insertion sequence for the wand assembly and water bottle of FIG. 4.
Figure 5B:
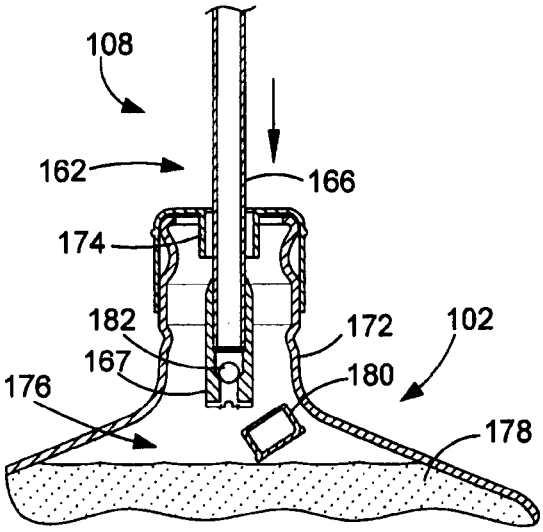
Figure 5C:
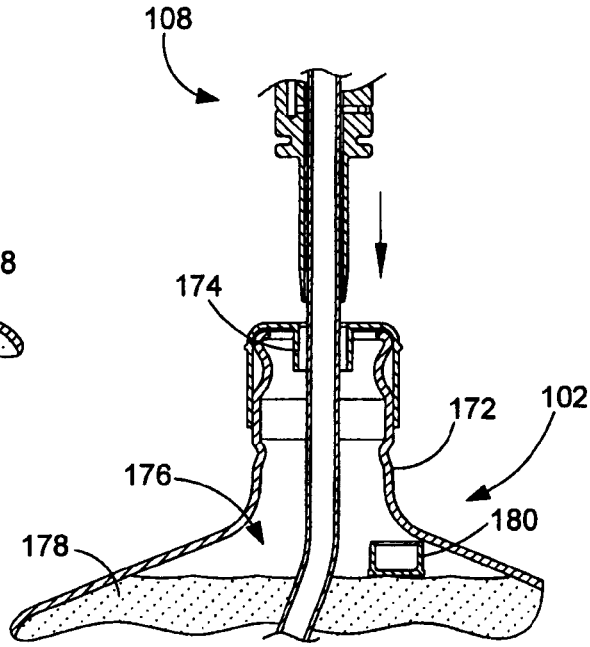

As shown in FIGS. 5A-5C, in some preferred embodiments the insertion of the wand assembly 108 serves to dislodge the plug 180 from the sidewall 174. This allows the plug 180 to remain out of the way during the resulting water drawing process. FIGS. 5A and 5B also show the tip assembly to preferably comprise a ball check valve 182, which operates to prevent siphoning of the water from the reservoir 122 back into the bottle 102, as well as leakage when the wand assembly 108 is removed from the bottle 102 (FIGS. 1A-1B).

Figure 6:
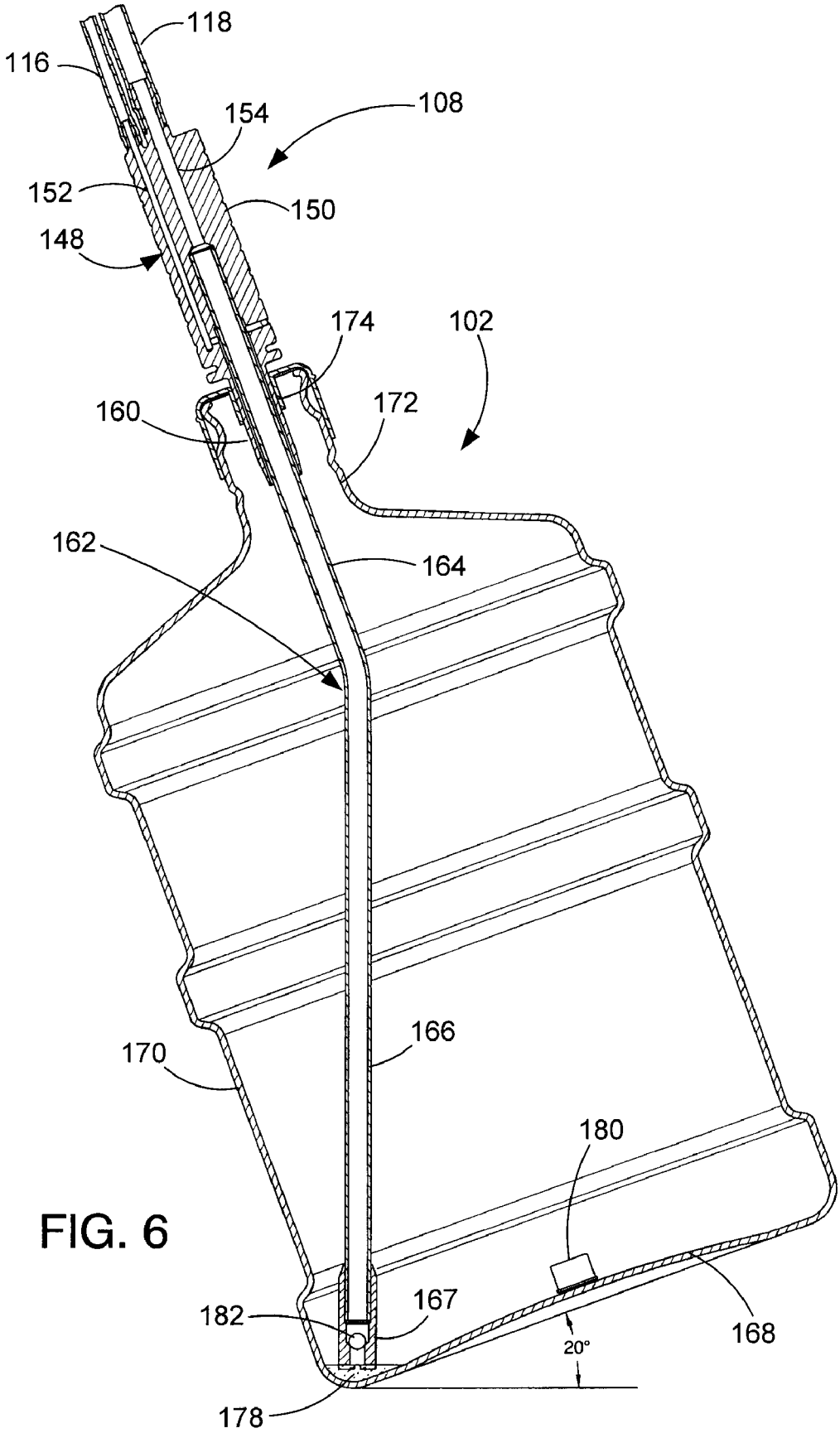
FIG. 6 corresponds to FIG. 4 with the water bottle in an empty condition.

FIG. 6 generally corresponds to FIG. 4 and shows the bottle 102 after substantially all of the water 178 has been removed. It can be seen from FIG. 6 that the angled orientation of the bottle, along with the novel configuration of the wand assembly 108, advantageously permit a greater amount of the water 178 from the bottle 102 to be accessed as compared to previous designs.

FIGS. 7-9 illustrate the water bottle transport assembly 112 in greater detail. The transport assembly 112 is adapted to transport the water bottle 102 from a remote storage location to a location adjacent the dispenser unit 104, as shown in FIGS. 1A-1B, without the need to manually lift and carry the bottle to the dispenser unit. The transport assembly 102 further supports the water bottle 112 at this location at the aforementioned orientation, which further eliminates the need to lift, invert and place the water bottle 102 onto the dispenser unit 104.

The transport assembly 112 comprises a rigid frame 184 which supports at least one rotatable wheel 186 (and preferably two as shown). The frame 184 includes a user handle 188 (best viewed in FIGS. 1A and 2A). A rotatable cradle 190 is attached to the frame 184 and is adapted to support the water bottle 102.

Figure 7A:
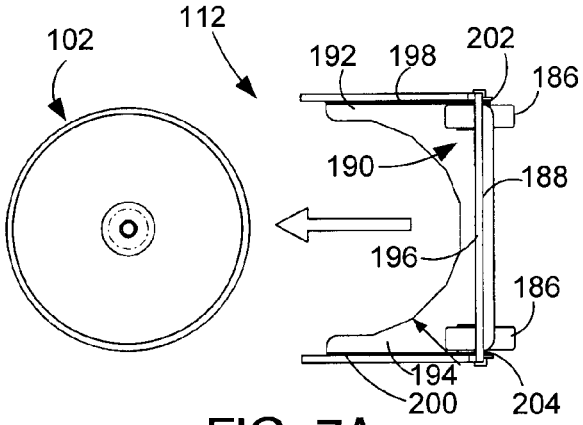
FIGS. 7A and 7B provide top and side views, respectively, of the water bottle transport assembly adjacent the water bottle of FIGS. 1A-2B.
Figure 8A:
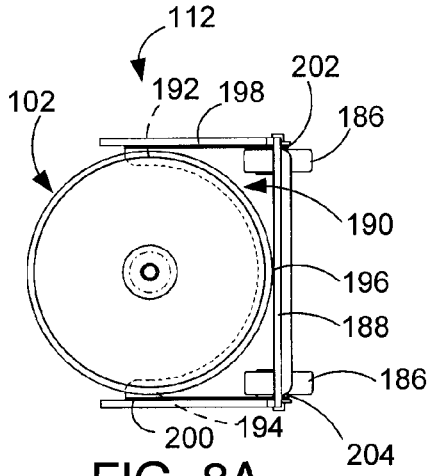
FIGS. 8A and 8B provide top and side views, respectively, of the water bottle supported by the transport assembly.
Figure 7B:
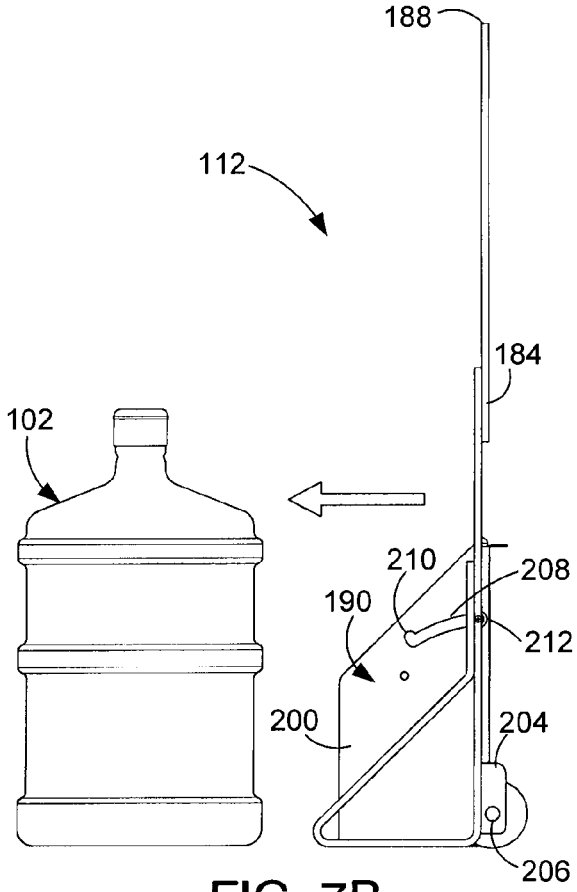
Figure 8B:
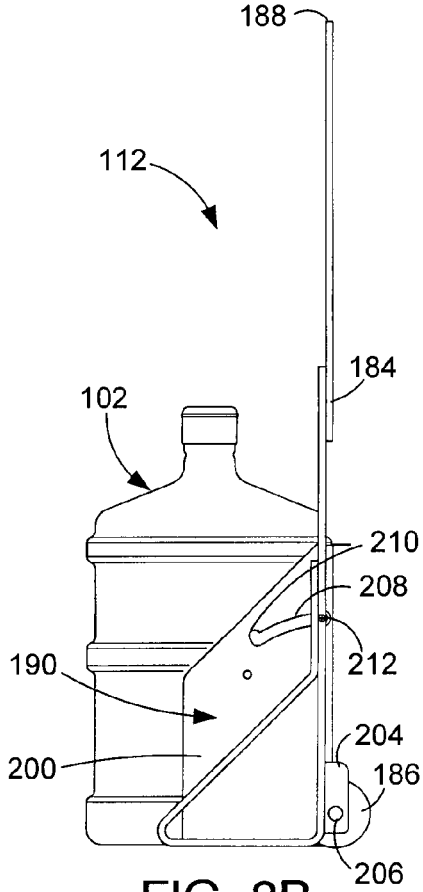

The cradle 190 preferably comprises first and second support arms 192, 194 which are configured to slide under the opposing sides of the water bottle 102, as indicated by FIGS. 7A and 7B. This advantageously allows the transport assembly 112 to engage the water bottle 102 without the need to tilt or otherwise lift the bottle 102 by hand from its original upright position (FIGS. 8A and 8B).

While the support arms 192, 194 preferably engage the bottom of the bottle 102 (i.e., at the radiused junction between base 168 and sidewall 170), the arms 192, 194 can be alternatively configured to engage other opposing surfaces of the bottle, such as at a suitable point along the sidewall 170, as desired. A central support surface 196 further preferably engages another side of the bottle 102 to halt further sliding movement of the arms 192, 194 adjacent the bottle 102.

Figure 9A:
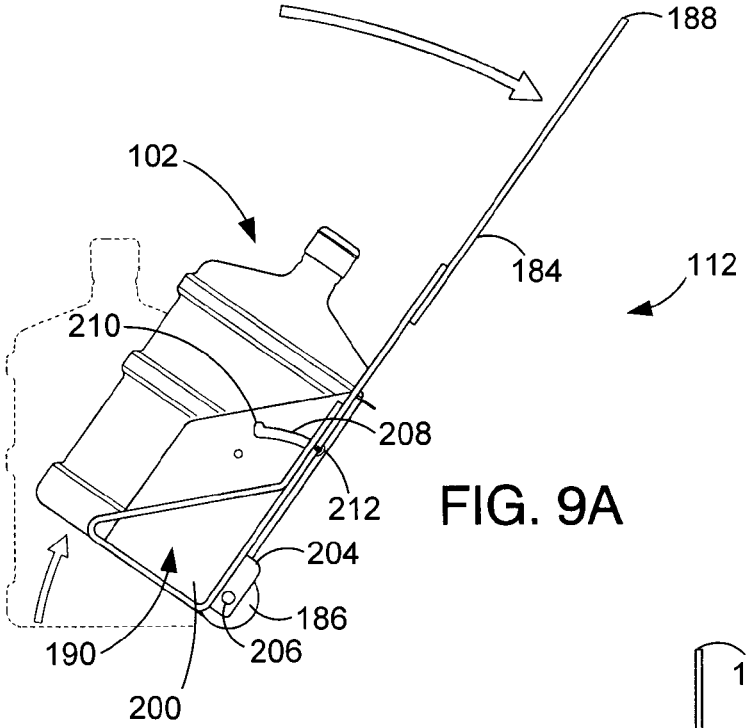
FIGS. 9A-9C illustrate a preferred sequence whereby the water bottle is supported in a desired orientation through manipulation of the transport assembly.

Once so engaged, the user applies a pivotal downward force upon the handle 188 to rotate the transport assembly 112 and the bottle 102 to the position shown in FIG. 9A. At this point, the transport assembly 112 and the bottle 102 are supported by the wheels 186 in a manner similar to a conventional hand truck.

Figure 9B:
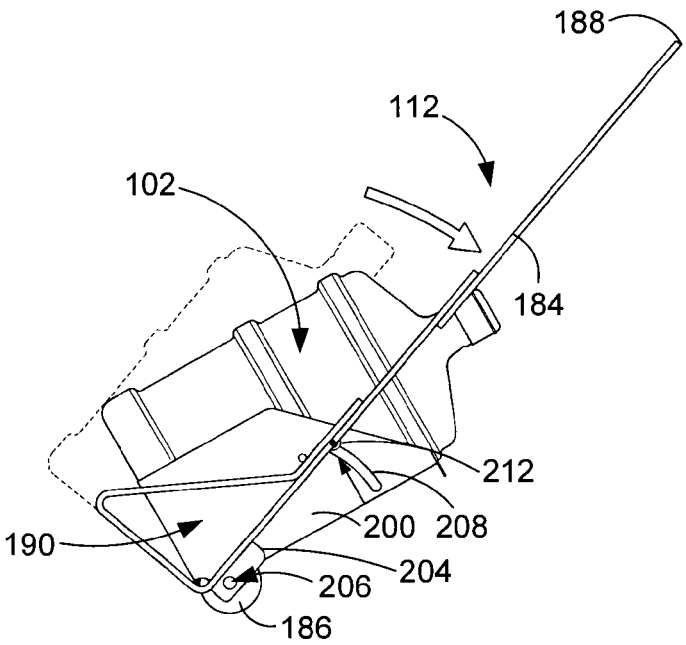

Continued user rotation of the handle 188, however, ultimately shifts the center of gravity of the water bottle 102 to a sufficient point to induce rotation of the water bottle 102 and the cradle 190 with respect to the frame 184, as shown in FIG. 9B.

This rotation of the cradle 190 is preferably facilitated as follows. The cradle 190 is provided with opposing side walls 198, 200 with respective flanges 202, 204. The flanges 202, 204 extend adjacent the wheels 186 and are each provided with a central aperture through which a wheel axis 206 passes (the wheel axis also supports the wheels 186).

Elongated slots (one shown at 208) are provisioned in each of the sidewalls 198, 200, each terminating with a detent portion 210. Fixed pins (one shown at 212) project from the frame 184 and are captured in the respective slots 208.

Thus, as the transport assembly 112 is rotated from the position shown in FIG. 9A to the position shown in FIG. 9B, the cradle 190 rotates about the wheel axis 206 and the fixed pins 212 pass along the slots 208 and into the detent portions 210, thereby locking the cradle 190 in the "reclined" position of FIG. 9B.

Figure 9C:
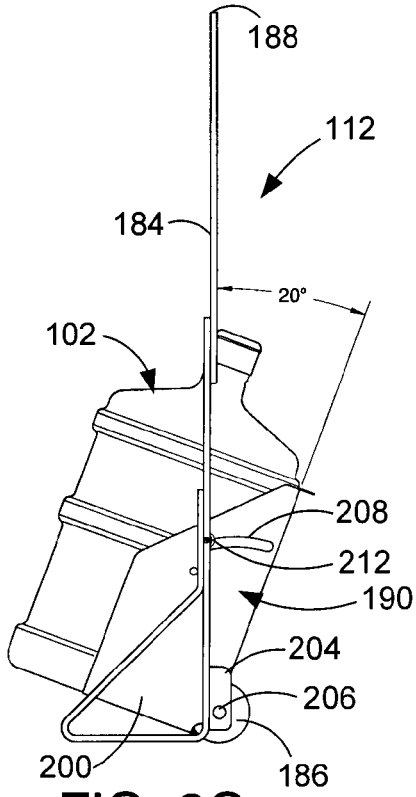

Once the transport assembly 112 is moved to the final destination (e.g., adjacent the dispenser unit 104), the user rotates the handle 188 back to the original, upright position as shown in FIG. 9C, and the bottle 102 is retained in the aforementioned angled orientation of FIGS. 4 and 6.

Once the contents of the water bottle 102 have been emptied into the reservoir 122 as explained above, the empty water bottle can be readily lifted out of the cradle 190 by the user. The cradle 190 can be reset to the original upright position of FIGS. 7A-7B by lifting the cradle 190 upwardly so as to slide the pins 212 out of the detent portions 210. Gravity will induce rotation of the cradle 190 about the axis 206 and the pins 212 will slide relative to the slots 208.

Figure 10:
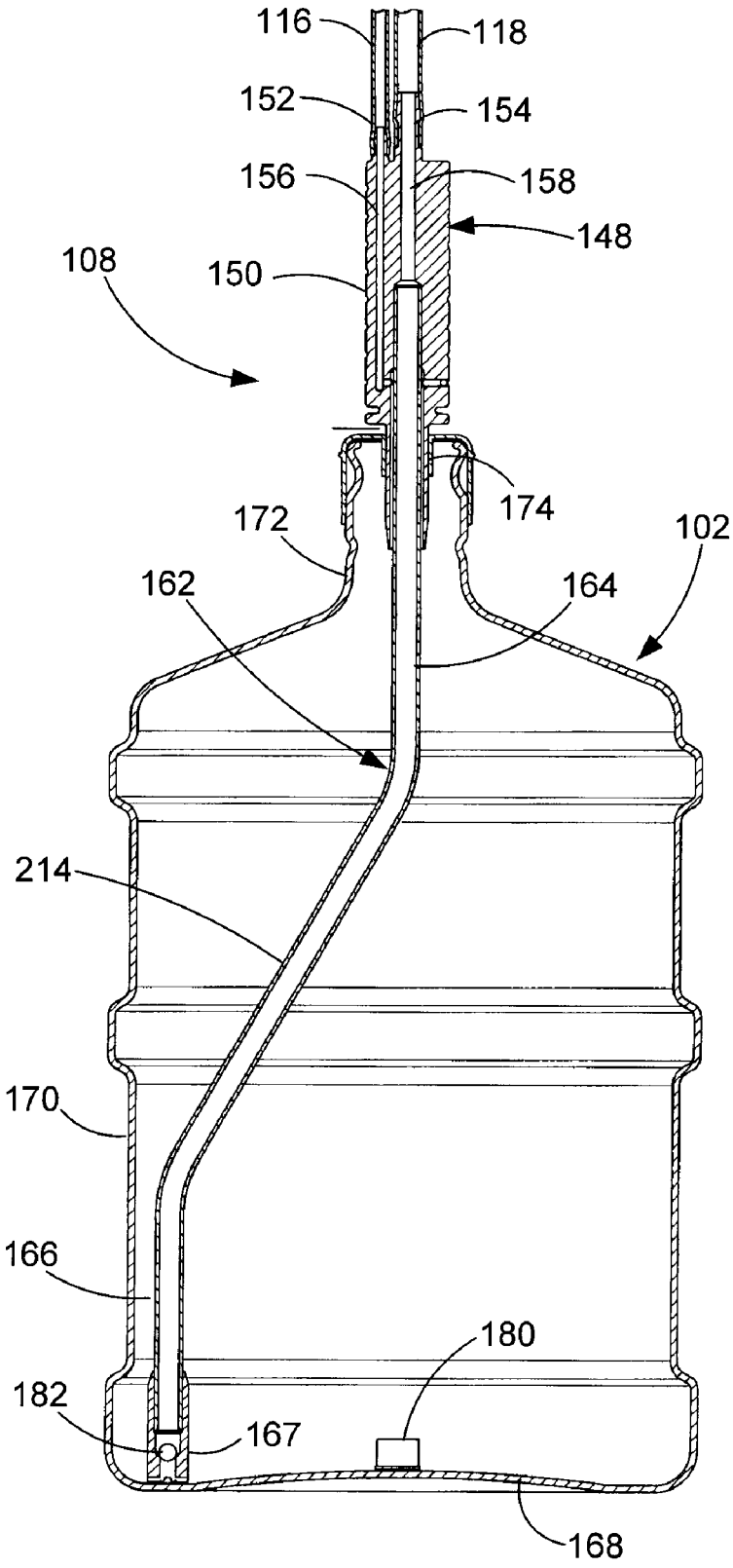
FIG. 10 provides another preferred embodiment for the wand assembly of FIG. 4.

While the preferred embodiments presented thus far have utilized a wand assembly 108 with a water drawing (first) conduit 162 with only two segments 164, 166, such is not necessarily limiting. For example, FIG. 10 shows an alternative conduit 162 with an additional segment 214 interposed between segments 164, 166. Any multiple number of segments can be utilized so long as the conduit 162 remains rigid to permit easy insertion and removal from the neck 172 of the bottle 102 as well as precise placement of the tip assembly 167 within the desired location in the bottle 102. Care should also be taken to ensure that the angular orientations and lengths of the respective segments are such that the conduit can in fact be inserted and removed from the bottle 102.

Figure 11:
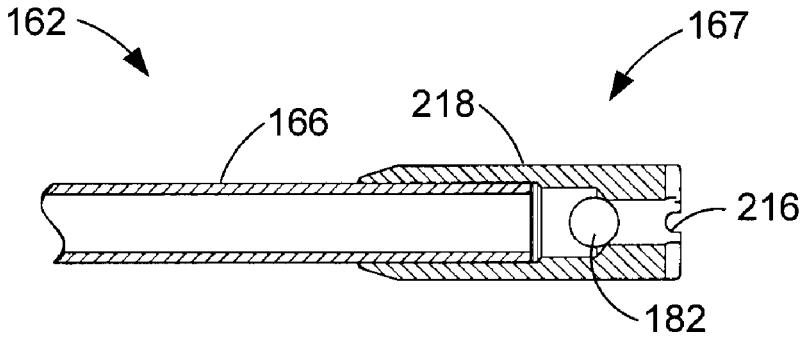
FIGS. 11, 12, 13A and 13B show alternative preferred constructions for a tip of the wand assembly of FIG. 4.

FIG. 11 shows the aforedescribed tip assembly 167 in greater detail. Inlet water is drawn through a port 216 in a body 218 of the tip assembly 167, and then up through the first conduit 162.

Figure 12:
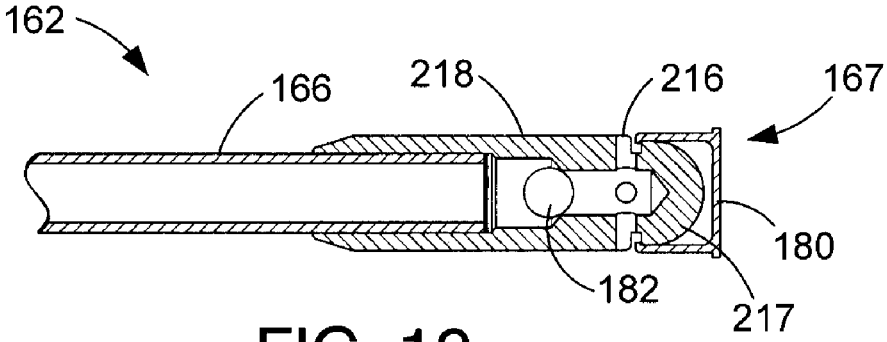

As desired, the tip assembly 167 can be provisioned with a radiused engagement member 217 as shown in FIG. 12. The engagement member 217 is configured to capture the plug 180 during insertion (see FIG. 5A) so that the plug 180 is retained on the distal end of the tip assembly 167. This further allows the plug 180 to be replaced back in its original position adjacent the sidewall 174 when the wand assembly 108 is subsequently retracted from the bottle 102. Water is drawn through port 216 as before, albeit at a slightly higher elevation within the bottle 102 as compared to the embodiment of FIG. 11.

Figure 13A:
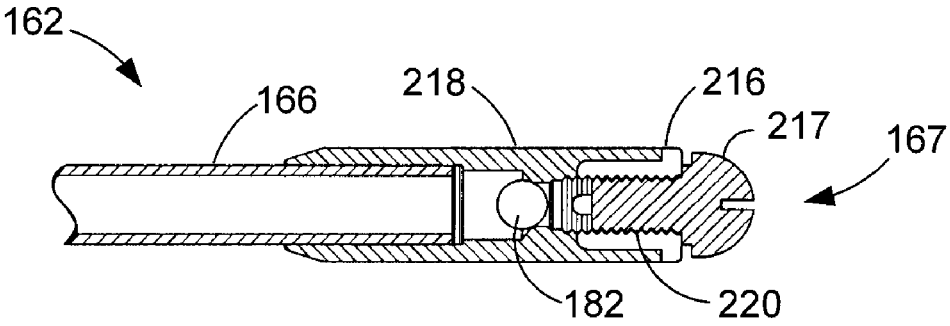
Figure 13B:
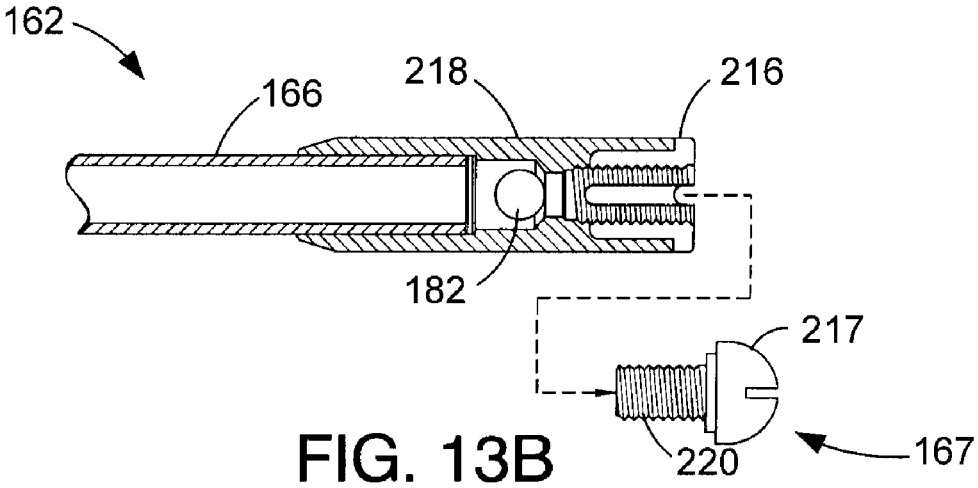

As shown in FIGS. 13A and 13B, the engagement member 217 can further be provisioned with threads 220 for removeable engagement with the body 218. In this way, the engagement member 217 can be placed onto the tip assembly 167 to grasp the plug 180 as in FIG. 12, or can be removed to allow the plug 180 to be displaced and fall into the bottle 102 as with the embodiment of FIG. 11.

From the foregoing discussion it will be apparent that preferred embodiments of the present invention present several advantages over the prior art. The system 100 advantageously eliminates the need to lift, carry and invert the water bottle 102 in order to place the water from the bottle into the dispenser unit 104. The unique orientation of the wand assembly 108 ensures that practically all of the water from the bottle 102 is moved to the reservoir 122. The transport assembly 112 further advantageously eliminates the need to pick up or move by hand a water bottle, which can be particularly helpful in situations where multiple bottles are stored in a remote location and moved one at a time for use by the dispenser unit 104, or whenever users have limited physical strength or mobility, or to reduce the risk of back injury in otherwise healthy persons.

Accordingly, preferred embodiments of the present invention are generally directed to an apparatus for transferring water to a bottled water dispenser (such as 104).

In accordance with some preferred embodiments, a wand assembly (such as 108) is configured to engage a neck (such as 172) of a non-inverted water bottle (such as 102) to draw water therefrom. The wand assembly preferably comprises a housing (such as 148) with respective inlet and outlet ports (such as 152, 154); a bent, rigid first conduit (such as 162) coupled to the outlet port and extending from the housing into an interior of the water bottle, the first conduit comprising a first segment (such as 164, 214) extending in a first direction and a second segment (such as 166) extending from the first segment in a second direction non-parallel to the first direction; and a second conduit (such as 160) coupled to the inlet port and extending from the housing into the interior of the water bottle.

In this way, a flow of pressurized water (such as 178) from the water bottle passes along the first conduit and to the outlet port in response to a flow of pressurized air from a pressurized air source through the inlet port and the second conduit. Preferably, the first and second conduits are aligned so that the second conduit surrounds the first segment of the first conduit (as in FIG. 4A), thereby maximizing the size of the first conduit as previously explained.

Preferably, the water bottle comprises a resealable stopper assembly (such as at 174) with a central aperture passing therethrough to the interior of the water bottle, wherein the first and second conduits are adapted to sealingly pass through said central aperture. The stopper assembly further preferably comprises an interior removeable plug (such as 180), and wherein the second segment of the first conduit comprises a distal end (such as 167, 218) configured to engage said plug so that, as the first conduit is inserted into the bottle, the plug is removed from the stopper assembly and, as the first conduit is subsequently removed from the bottle, the plug is replaced onto the stopper assembly.

In further preferred embodiments, a water bottle transport assembly (such as 112) is adapted to transport a water bottle in a substantially non-inverted orientation. The transport assembly preferably comprises a rigid frame (such as 184) supporting at least one wheel (such as 186) and comprising a user handle (such as 188), and a cradle (such as 190) supported by and rotatable with respect to the frame, the cradle comprising first and second support arms (such as 192, 194) configured to contactingly support opposing first and second exterior sides of the bottle, wherein the first and second support arms are further configured to pass adjacent to the respective first and second exterior sides of the bottle to engage said sides without lifting or tilting said bottle.

The cradle further preferably comprises a central support surface (such as 196) configured to contactingly support a third exterior side of the bottle between the first and second exterior sides, wherein upon engagement of said first and second exterior sides of the bottle by the first and second arms and downward pivotal movement of the handle, the bottle is tilted into a supported orientation in the cradle and the third exterior side of the bottle contactingly abuts the central support surface of the cradle (such as in FIG. 9B).

In further preferred embodiments, a cover assembly (such as 110) is provided to sealingly cover an inlet aperture (such as 128) of the water dispenser unit with the aperture being nominally configured to receive the water bottle in an inverted orientation to pass water from the bottle to an underlying reservoir (such as 122).

The cover assembly preferably comprises an air pump (such as 130) coupled to a flexible third conduit (such as 116) to pass said flow of pressurized air to the inlet port, and wherein a flexible fourth conduit (such as 118) passes from the outlet port and through the cover assembly so that upon operation of the air pump, said flow of pressurized air is directed along the third conduit and a return flow of said pressurized water is directed along the fourth conduit and into the reservoir.

For purposes of the appended claims, it will be understood that the recited "first means" corresponds to at least the disclosed wand assembly 108 and the cover assembly 110. The recited "second means" will be understood to correspond to at least the disclosed water bottle transport assembly 112.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular environment without departing from the spirit and scope of the present invention.

What is claimed is:

1. An apparatus comprising a water bottle transport assembly adapted to transport a water bottle in a substantially non-inverted orientation, the transport assembly comprising a rigid frame comprising a user handle, the rigid frame coupled to at least one wheel, and a cradle supported by and rotatable with respect to the frame, the cradle comprising first and second support arms configured to contactingly support opposing first and second exterior sides of the bottle, wherein the first and second support arms are further configured to pass adjacent to the respective first and second exterior sides of the bottle to engage said sides without lifting or tilting said bottle, wherein motion of the cradle is restrained with a pin affixed to the first and second support arms that each communicates with a slotted bracket connected to the frame on opposing sides of the cradle, and further wherein the slotted brackets set the cradle either in an orientation that matches the frame or an angled position relative to the frame and further comprising a wand assembly configured to engage a neck of the water bottle while the water bottle is supported by the cradle of the transport assembly at said angled position relative to the frame, the wand assembly comprising:

a housing with respective inlet and outlet ports;

a bent, rigid first conduit coupled to the outlet port and extending from the housing into an interior of the water bottle, the first conduit comprising a first segment extending in a first direction and a second segment extending from the first segment in a second direction non-parallel to the first direction; and a second conduit coupled to the inlet port and extending from the housing into the interior of the water bottle, wherein a flow of pressurized water from the water bottle passes along the first conduit and to the outlet port in response to a flow of pressurized air from a pressurized air source through the inlet port and the second conduit;

wherein the angled position of the water bottle relative to the frame extends along a first selected angle, and wherein the second segment of the first conduit extends at a second selected angle complementary to the first selected angle so that a distal end of the first conduit extends into a lowest elevation of a circumferentially extending, axially symmetric sump region along an interior bottom surface of the bottle.

2. The apparatus of claim 1, wherein the cradle is further configured to support the water bottle at an inclined orientation while the frame is in a substantially upright orientation, and wherein the first selected angle is selected such that upon insertion of the first conduit into the interior of the water bottle, the distal end of the first conduit extends substantially vertically to a position adjacent a lowest point within the interior of the bottle.

3. The apparatus of claim 1, further comprising a cover assembly configured to sealingly cover an inlet aperture of a water dispenser unit with the aperture being nominally configured to receive the water bottle in an inverted orientation to pass water from the bottle to an underlying reservoir, the cover assembly comprising an air pump coupled to a flexible third conduit to pass said flow of pressurized air to the inlet port, and wherein a flexible fourth conduit passes from the outlet port and through the cover assembly so that upon operation of the air pump, said flow of pressurized air is directed along the third conduit and a return flow of said pressurized water is directed along the fourth conduit and into the reservoir.

4. The apparatus of claim 1, wherein the cradle is further rotatable with respect to the user handle.

5. An apparatus comprising:

a housing with respective inlet and outlet ports;

a bent, rigid first conduit coupled to the outlet port and extending from the housing into an interior of the water bottle, the first conduit comprising a first segment extending in a first direction and a second segment extending from the first segment in a second direction non-parallel to the first direction;

a second conduit coupled to the inlet port and extending from the housing into the interior of the water bottle, wherein a flow of pressurized water from the water bottle passes along the first conduit and to the outlet port in response to a flow of pressurized air from a pressurized air source through the inlet port and the second conduit, wherein the second segment is positioned in a first angle relative to the frame before water is drawn from a water bottle with a annularly symmetric reservoir and in only a substantially vertical position while water is drawn therefrom; and a water bottle transport assembly adapted to transport a water bottle in a substantially non-inverted orientation, the transport assembly comprising a rigid frame and comprising a user handle, the rigid frame coupled to at least one wheel, and a cradle supported by and rotatable with respect to the user handle, the cradle comprising first and second support arms configured to contactingly support opposing first and second exterior sides of the bottle, wherein the first and second support arms are further configured to pass adjacent to and engage the respective first and second exterior sides of the bottle wherein motion of the cradle is restrained with a pin affixed to the first and second support arms that each communicates with a slotted bracket connected to the frame on opposing sides of the cradle, and further wherein the slotted brackets set the cradle either in an orientation that matches the frame or an angled position relative to the frame, in which the angled position comprises the cradle rotated to a predetermined angle that is complementary to the first angle of the second segment.

6. The apparatus of claim 5, wherein the first and second conduits are aligned so that the second conduit surrounds the first segment of the first conduit.

7. The apparatus of claim 5, further comprising a valve disposed adjacent to a distal end of the first conduit.

8. The apparatus of claim 5, wherein distal end of the first conduit comprises a tip assembly which is configured to capture and displace a removeable plug of the water bottle when the first conduit is inserted into the water bottle, retain the removeable plug on the tip assembly as the tip assembly is submerged into said water, and which replaces the removable plug as the first conduit is retracted from the water bottle.

9. The apparatus of claim 5, further comprising a water transfer conduit configured to transfer water from a water bottle, the water transfer conduit comprising a tip assembly at a distal end thereof configured to contactingly displace a removeable sealing plug of the water bottle during insertion of the water transfer conduit into the water bottle, and to retain the sealing plug onto the tip assembly during said transfer of water from the water bottle so that the distal end and the sealing plug are submerged within said water in the water bottle.

10. The apparatus of claim 9, wherein the tip assembly is further configured to replace the sealing plug to reseal the water bottle during subsequent retraction of the water transfer conduit from the water bottle.

11. The apparatus of claim 9, further comprising a pressurization conduit configured to pressurize a vapor space of the water bottle so that the water transferred along the water transfer conduit is pressurized in response to said pressurization of the vapor space of the water bottle.

12. The apparatus of claim 9, wherein the tip assembly further comprises a check valve.

13. The apparatus of claim 9, wherein the tip assembly comprises an annular recess which captures a flange of the removeable sealing plug thereby retaining said plug on the tip assembly.

14. The apparatus of claim 9, wherein the tip assembly engagement member is configured to be removably attachable to a body portion of the tip assembly by a user.

15. The apparatus of claim 9, wherein the sealing plug forms a portion of a stopper assembly coupled to the water bottle, and wherein the sealing plug is reinserted into the stopper assembly by the tip assembly as the water transfer conduit is retracted from the water bottle.

* * * * *